United States Patent [19]

Newns et al.

[11] 4,083,750

[45] Apr. 11, 1978

[54] FLOWBOX WITH CONVERGENT WALL PORTIONS

[75] Inventors: Michael David Newns; Brian William Attwood, both of Bristol, England

[73] Assignee: St. Anne's Board Mill Company Limited, Bristol, England

[21] Appl. No.: 682,594

[22] Filed: May 3, 1976

[30] Foreign Application Priority Data

May 6, 1975 United Kingdom ..... 19053/75

[51] Int. Cl.[2] ..... D21F 1/02

[52] U.S. Cl. ..... 162/317; 162/336; 162/343; 162/344; 162/347

[58] Field of Search ..... 162/336, 337, 343, 344, 162/347, 301, 216, 217, 214, 317

[56] References Cited

U.S. PATENT DOCUMENTS

| | | | |
|---|---|---|---|
| 3,562,107 | 2/1971 | Schmaeng | 162/336 |
| 3,563,854 | 2/1971 | Nisser et al. | 162/336 X |
| 3,565,758 | 2/1971 | Higgins et al. | 162/336 |
| 3,622,450 | 11/1971 | Attwood et al. | 162/343 X |
| 3,878,039 | 4/1975 | Descary et al. | 162/336 |
| 3,945,882 | 3/1976 | Egelhof et al. | 162/336 X |

*Primary Examiner*—Richard V. Fisher

*Attorney, Agent, or Firm*—Larson, Taylor and Hinds

[57] ABSTRACT

For a paper, board or similar fibrous web making machine, a flowbox comprising an enclosed explosion chamber having upstream and downstream walls converging from a top wall toward a bottom wall, the stock inlet being directed at the downstream wall adjacent the region of convergence. A stock outlet is provided by non-divergent upper and lower plates defining an exit slice, the lower plate being a continuation of the bottom wall and the lower plate being shorter than the upper plate.

14 Claims, 12 Drawing Figures

Figure 5:
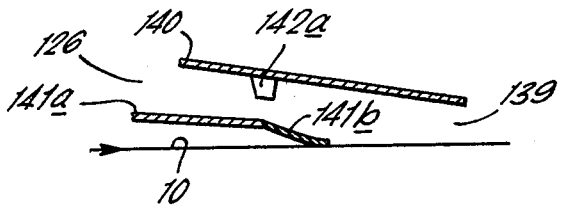

FIG. 4.
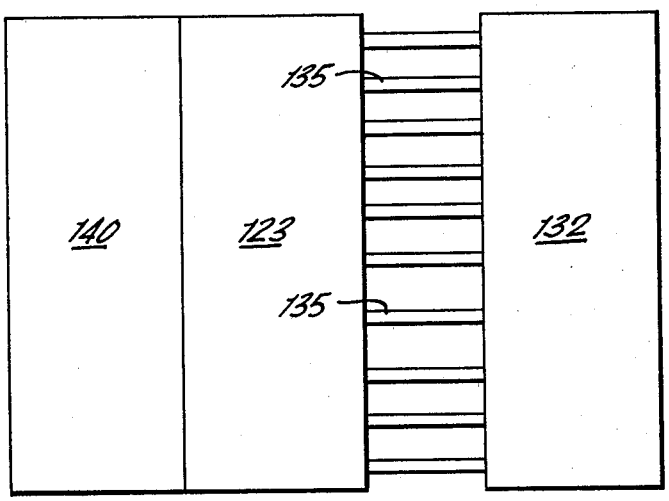
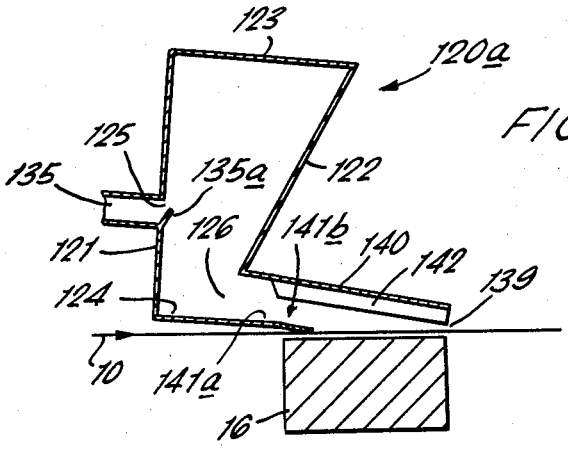
FIG. 5.
FIG. 5(a).
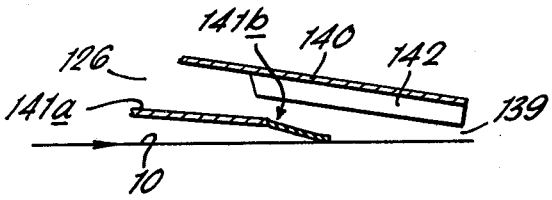

FLOWBOX WITH CONVERGENT WALL PORTIONS

This invention is related to improvements to flowboxes for machines for dewatering watery fibrous pulp or stock to form a sheet, e.g. in the manufacture of paper or board.

The invention particularly relates to improvements in the type of flowbox having a component known in the art as an "explosion chamber", which, as used in the instant specification and claims, is a chamber in which a high speed stream of stock is very quickly changed in speed and direction of flow by rapid expansion and/or impingement on an obstruction within the chamber, whereby the stream disintegrates or "explodes" to cause mixing and deflocculation of the stock by the generation of turbulence. One such explosion chamber is described in our U.K. Pat. No. 1179847.

Long-fibre free-beaten stock cannot easily be utilized in flowboxes incorporating explosion chambers of the prior art. It is an object of the present invention to provide a flowbox incorporating an explosion chamber which can utilize such stock.

According to a first aspect of the present invention there is provided a flowbox for a paper, board or similar fibrous web making machine, the flowbox comprising an enclosed explosion chamber having upstream and downstream convergent wall portions converging from a top wall portion towards a bottom wall portion, wherein a stock inlet is disposed in the upstream portion and is directed towards the downstream wall portion so that a jet of stock emanating from the inlet impinges against the downstream wall portion adjacent the region of closest approach of the upstream and downstream wall portions.

According to a second aspect of the present invention, in a paper, board or similar fibrous web making machine there is provided the combination of an explosion chamber flowbox with a dewatering means, wherein the explosion chamber includes an exit slice comprising non-divergent upper and lower plates, the lower plate being shorter than the upper plate, and the dewatering means being located underneath the projecting end of the upper plate.

The explosion chamber may be according to the first aspect of the invention.

Figure 1:
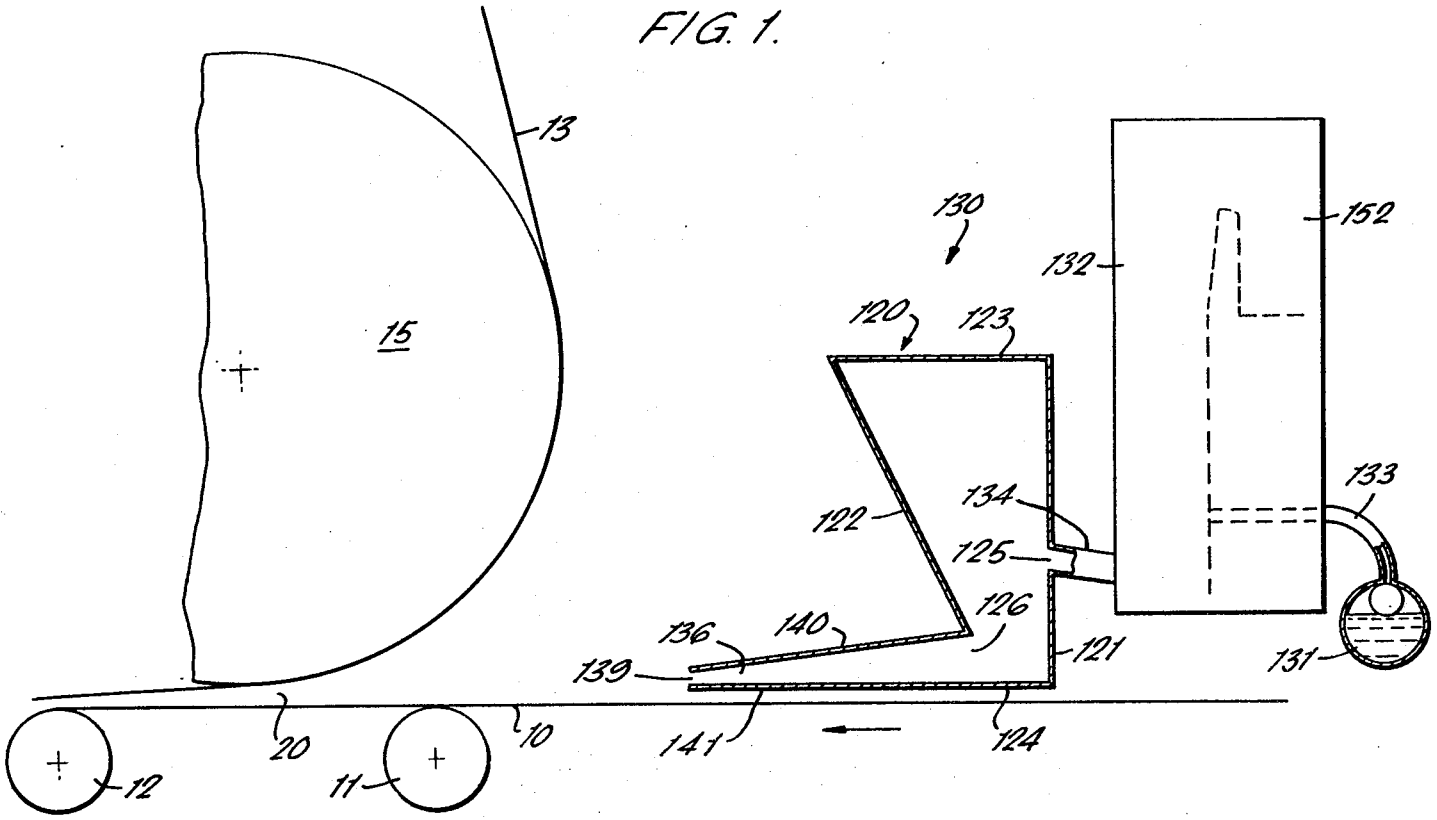
Figure 2:
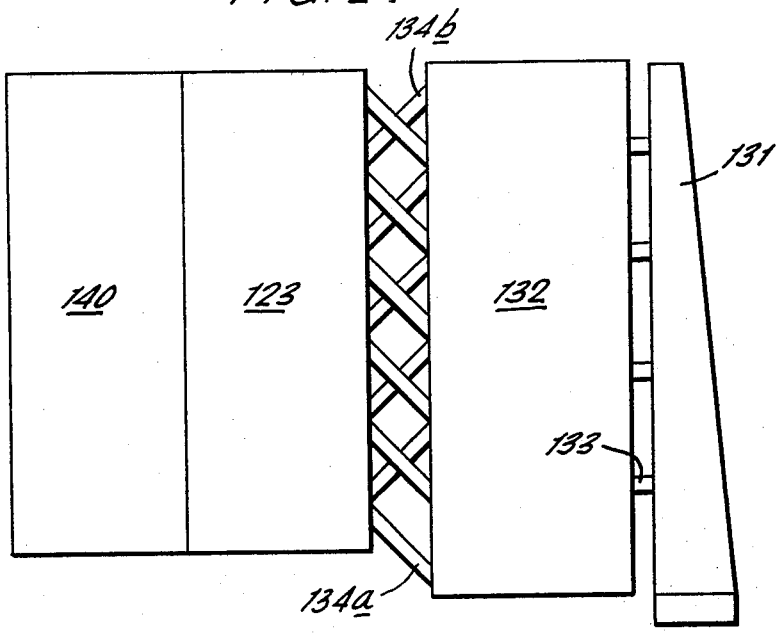
Figure 3:
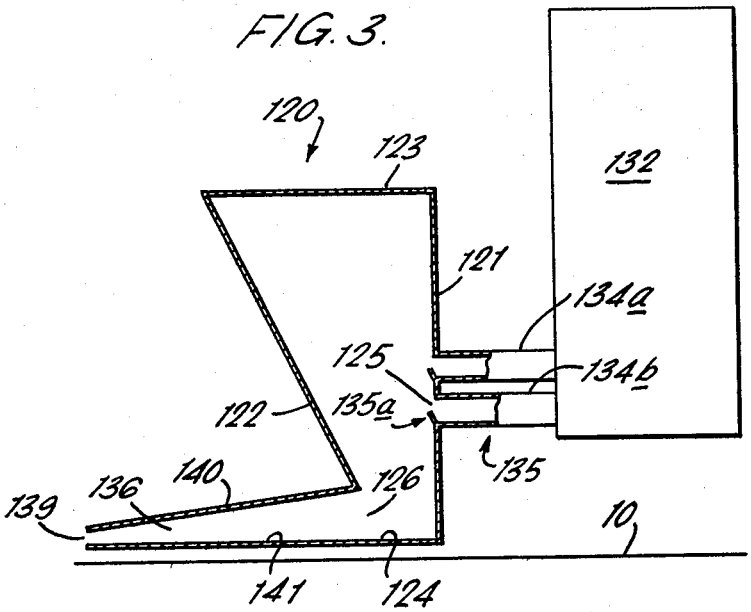
Figure 6:
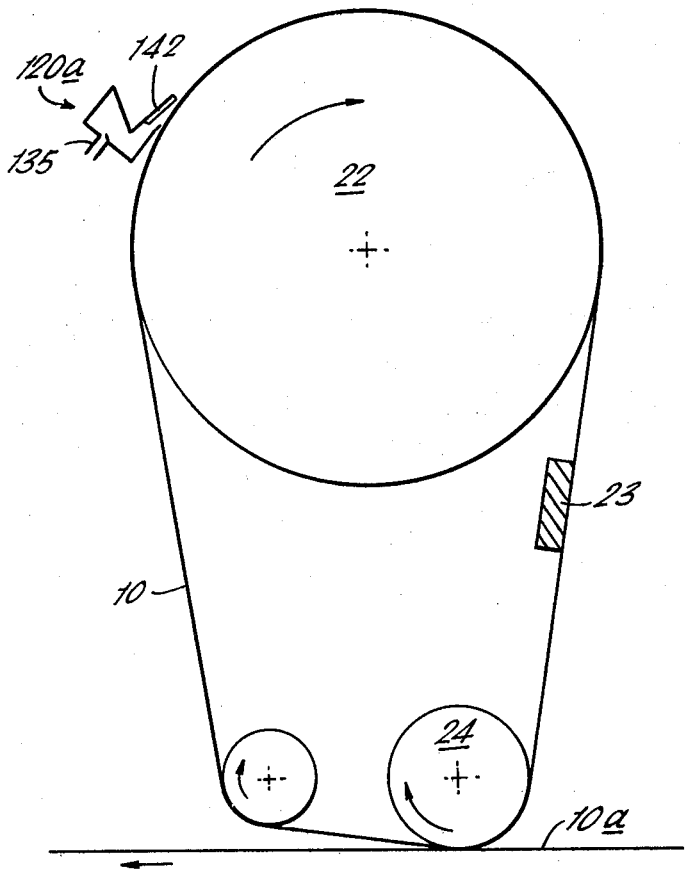
Figure 7:
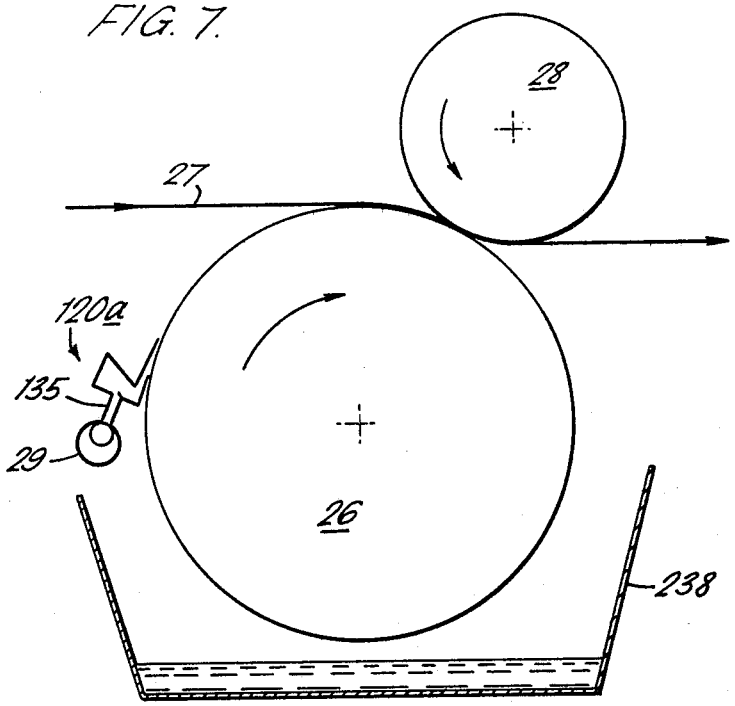
Figure 8:
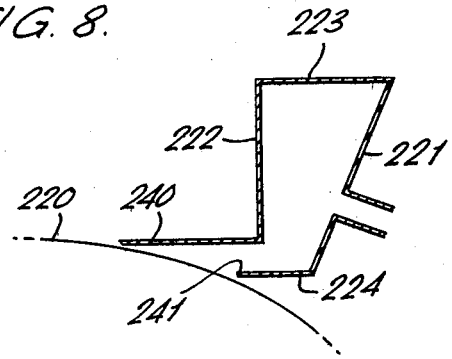
Figure 9:
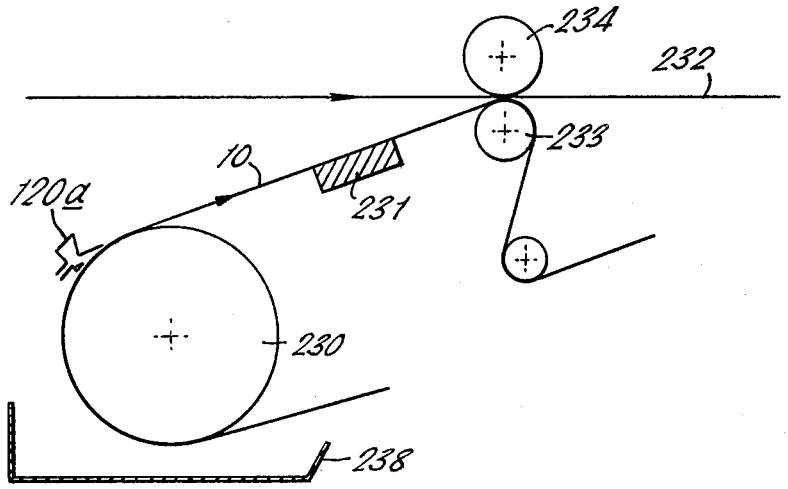
Figure 10:
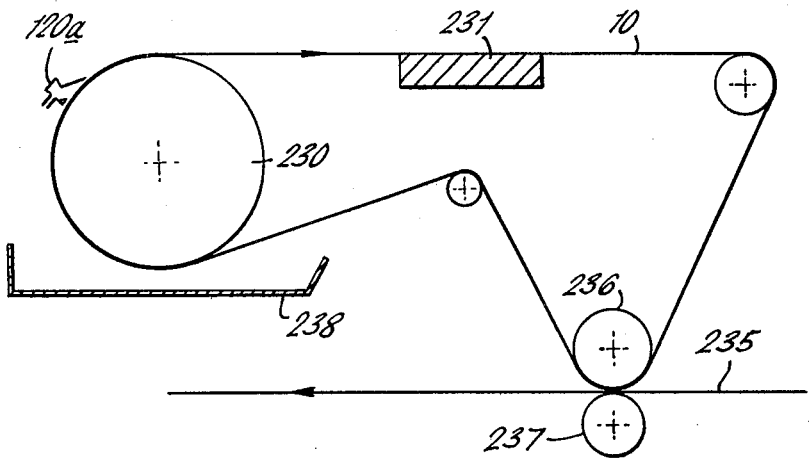

The invention will now be described by way of example with reference to the accompanying diagrammatic drawings in which, FIG. 1 is a cross-section side view of part of a board-making machine including a header tank and a flowbox, FIG. 2 is a plan view of the header tank and flowbox of FIG. 1, FIG. 3 is a side view in part cross-section of an alternative form of the flowbox and header tank of FIGS. 1 and 2, FIG. 4 is a plan view of the apparatus shown in FIG. 3, FIG. 5 is a cross-section side view of an alternative form of the flowbox of FIGS. 3 and 4, including a dewatering means, FIG. 5(*a*) is an enlargement of a portion of the flowbox of FIG. 5, FIG. 5(*b*) is a modification of the flowbox of FIG. 5 and 5(*a*), FIG. 6 is a side view of a cylinder mould forming section of a multi-ply forming machine including a flowbox, FIG. 7 is a side view of a further cylinder mould forming section of a multi-ply forming machine including a flowbox, FIG. 8 is a cross-section side-view of a further alternative form of flowbox, and FIGS. 9 and 10 are side views of yet further alternative forming sections including a flowbox.

Referring to FIG. 1 of the drawings there is shown a single-ply stage of a multi-ply board-making machine, for example as shown in FIG. 1, a twin-wire former. A horizontal main wire or forming band 10 of metal or plastics material carrying a dewatered web from a previous stage passes over a table roll 11 and a further roll 12. An upper wire 13 of the stage illustrated passes around a forming roll 15 to pass over roll 12 in overlying relationship with the main wire 10. The lengths of wires between rolls 11 and 12 define therebetween a convergent gap 20 within which stock is initially dewatered to form a fibrous mat.

To feed the stock into gap 20 there is provided a flowbox indicated generally at 130. The flowbox 130 comprises a cross-flow manifold 131, a header tank 132, and an explosion chamber 120 according to the invention.

Cross-flow manifold 131 is of cross-section decreasing in the direction of flow. Stock pumped through this manifold is fed into the header tank 132 through a plurality of ducts 133 spaced across the machine, as is shown in plan view in FIG. 2, only one such duct 133 being shown in FIG. 1. An overflow chamber 152 is provided in header tank 132. Stock within header tank 132 is fed to the explosion chamber 120 through stock inlet tubes to be described below.

The explosion chamber 120 comprises, extending across the width of the machine wire, a closed metal box of quadrilateral cross-section, taken in the direction of the machine wire. The quadrilateral is defined by planar walls 121-124 forming respectively upstream, downstream, top and bottom walls of the chamber. "Upstream" is used to refer to that side of the explosion chamber nearer the headbox, whilst "downstream" is used to refer to that side of the explosion chamber nearer the forming roll 15.

The upstream and downstream walls converge from the top wall to the bottom wall. In the embodiment shown in the drawings the top and bottom walls are substantially parallel, the upstream wall is substantially perpendicular to the machine wire 10, the angle of convergence between the upstream and downstream walls is about 25°, and the distance between the top and bottom walls is greater than the distance between the upstream and downstream walls at their greatest separation. An outlet 126 is provided in the bottom portion of downstream wall 122, immediately adjacent bottom wall 124. Outlet 126 communicates with a slice 139 by a shear-flow passage or channel 136. Stock from the slice 139 is directed onto the wire 10 towards the convergent gap 20.

Stock may be fed into the explosion chamber through apertures 125 (only one of which is shown) in upstream wall 121 from the stock inlet tubes. The apertures 125 are located in the lower portion of the wall 121 in a position such that the flow of stock is directed at an angle to the downstream wall 122, and such that the flow from the tubes does not proceed directly into the outlet 126.

The stock inlet tubes may be arranged in a number of ways whereby the stock is fed into the explosion chamber, the criterion being that as the stock emanates from the inlet tubes into the explosion chamber at high speed it is directed upwards to impinge against downstream wall 122. The stock is then directed from downstream wall 122 towards the top wall and is caused to circulate violently in the chamber so that entangled fibre clots are torn apart. The deflocculated stock in the lower portion of the chamber is forced towards the outlet 126 and impingement against the bottom wall 124 of the chamber causes a violent change in the direction of flow, further assisting the deflocculating effect. Due to the restricted enclosed nature of the explosion chamber the resulting high-speed extremely turbulent deflocculated well-mixed stock immediately leaves the explosion chamber via the relatively narrow outlet 126.

Referring now to the stock inlet tubes, one arrangement of them is illustrated in FIGS. 1 and 2. Stock within header tank 132 flows upwardly at high speed through a plurality of stock inlet tubes 134 under the static head of stock in the header tank 132 into explosion chamber 20. As shown in FIG. 2, the tubes 134 are arranged criss-cross in two superposed sets of parallel tubes **134*a* and 134*b***. The tubes in each set are disposed in one plane, and are skew relative to those in the other set, thus destroying any irregularities in stock consistency across the width of the machine, as described in our U.K. Pat. No. 1179847.

Alternatively, as shown in FIGS. 3 and 4, the stock inlet tubes may be provided by tubes 135 which are substantially at right angles to wall 121 of the explosion chamber. Baffles **135*a* are provided at the inward opening ends of the tubes 135 to direct stock upwardly against wall 122**.

As shown in FIGS. 1 and 3, passage 136 leading from the explosion chamber is defined between convergent plates 140, 141 which thus do not allow any decrease in velocity of the high-speed stock, but eject it, as a high speed jet of a deflocculated fibrous suspension onto the wire 10 and into the convergent gap 20 of the board machine. Plate 141 is a continuation of the bottom wall 124 of the explosion chamber. The passage leading to the slice 139 need not be convergent but may be parallel-sided without allowing any decrease in stock velocity and would thus maintain the high-speed deflocculated jet required. However, divergent plates 140, 141 would have a deleterious effect on the speed and consistency of the jet. Plates 140, 141 may be made relatively adjustable for varying the size and disposition of passage 136.

Referring now to FIGS. 5, **5(*a*), 5(*b*) and 6 there is shown a modified embodiment 120*a* of the explosion chamber 120 of FIGS. 1–4. Features in FIGS. 5–6 similar to those of FIG. 3 are given identical numbers. The modified explosion chamber 120*a* differs from explosion chamber 120 in that the lower plate 141 of the convergent passage 136 is replaced by a shorter but otherwise similar lower plate 141*a*. In some uses of the flowbox the bar 142*a* may be a little disadvantageous in that stationary eddies in the stock flow may be formed downstream of bar 142*a*, whilst such eddies are prevented by turbulence generating plate 142**.

The purpose of the shortened lower plate **141*a* is to enable well-formed stock to be used in a web-forming operation immediately on leaving the explosion chamber, thereby minimizing reflocculation in the stock during its transit from the explosion chamber to the web-forming operation and permitting the formation of a fibrous mat on a wire underneath the top plate 140 before the stock emerges from the exit 139 into contact with free air. This avoids jet instabilities which can occur when a fibrous suspension is projected from a slice gap into free air before descending onto a wire, and which can cause undesirable streaks and flocculation in the web formed therefrom. Further deflocculation may be effected by the stock-accelerating effect of the turbulence plate 142 or bar 142*a***.

A flexible apron **141*b* is provided depending from the lip of lower plate 141*a* onto the wire 10 so as to prevent back-flow of stock under the lower plate 141*a*. This is shown in greater detail in FIGS. 5(*a*) and 5(*b*)**. The construction of such a device is already well known in the art.

In FIG. 5 the modified explosion chamber **120*a* is shown in relation to a forming wire 10, and is characterized in that a dewatering means such as a suction box 16 is located under the wire 10 immediately after the lower slice plate 141*a*. In this example the open area of the suction box 16 can extend as far as the limits of the upper slice plate 140. Consequently, well-formed stock applied to the wire 10, as described above, is virtually simultaneously dewatered as soon as it reaches the wire. It will be appreciated that a well-formed web is therefore formed in a very short distance (for example 10–20 cm) and significant savings in machinery space are achieved. The well-formed web on the wire 10** may be further dewatered on the wire by means already known in the art.

In FIG. 6 the modified explosion chamber **120*a* is shown feeding stock upwardly onto a wire 10 over a cylinder mould 22. Dewatering of the web may be assisted by a suction box 23 and/or by stationary suction boxes built inside the rotating cylinder mould shell in ways already practiced in the art. The web is then transferred to a main carrier wire 10*a* under roll 24**. This system could provide an additional forming section of a multi-ply machine.

FIG. 7 shows the modified explosion chamber **120*a* feeding stock onto a cylinder mould 26. In this example, which is in no way restricted to this embodiment, the stock is fed into the explosion chamber inlet tubes 135 directly by a cross-flow manifold 29 having a cross-section decreasing in the direction of flow. This manifold may be substantially circular in cross-section as shown, or any other shape without limiting the scope of the invention. The fibrous mat laid on the cylinder surface is dewatered during its traverse around the circular path by natural drainage through the cylinder wire. If the cylinder mould is suitably constructed, further dewatering may be accomplished by suction from boxes or zones within the cylinder. The fibrous mat is then couched from the surface of the cylinder mould onto a carrier felt 27 by the action of a couch roll 28. In this manner a number of plies may be built up on the carrier felt 27** to form a multi-ply board.

FIG. 8 shows an alternative form of flowbox in which upstream, downstream, top and bottom walls 221-224 respectively correspond to walls 121-124 of the flowbox of FIG. 1. In this alternative form, the downstream wall 222 is at right angles to the top wall and converges towards the bottom of the downstream wall. Stock emerges from the flowbox onto a cylinder mould 220 through slice plates 240 and 241 similar to corresponding slice plates 140, 141 in FIGS. 5, 5(*a*) and 5(*b*).

FIGS. 9 and 10 show the modified explosion chamber 120*a* when used with a spider roll 230. It is not possible to have vacuum dewatering incorporated in a spider roll so it is expedient to provide a vacuum dewatering box 231 beneath the main wire 10 after the wire has left the spider roll. The dewatered web is subsequently transferred to the underside of a further wire 232 by transfer rolls 233 and 234 in FIG. 9, and, in FIG. 10 to the topside of a further wire 235 by transfer rolls 236 and 237. In FIG. 10 it is possible to transfer any desired thickness of web onto wire 235.

In FIGS. 7, 9 and 10 catch-all pans 238 are provided beneath mould cylinder 26 and spider rolls 230 to catch excess water.

With the apparatus of the present invention 15 to 200 meters per minute of web may be expected to be laid.

Because of the distinctive shape of the explosion chamber of the invention and the manner in which the stock is directed into the chamber, it is possible to utilize longer fibred, freer beaten stock than is the case in the flowbox of U.K. Pat. No. 1179847, for example, or alternatively it is possible to form an equally acceptable formed sheet using significantly less fibre. This is particularly advantageous in multi-ply board making where a liner of expensive bleached pulp is used.

It will be appreciated that modifications may be made to the explosion chamber 120 or 120*a* or to the shear-flow channel slice plates 140, 141 within the scope of the invention. For instance, in the quadrilateral cross-section embodiment of the explosion chamber described above the angle of convergence of the downstream and upstream walls may vary over a wide range either side of 25°, say 20°–40°, and the top and bottom walls need not necessarily be substantially parallel, provided that the upper portion of the chamber is of larger cross-section than the lower, and stock is directed into the chamber in such a manner as to cause circulation of stock within the chamber so violently that fibre flocs are broken down. For example, the bottom wall 124 may be very short, so that the cross-section of the chamber approaches or even becomes a triangular shape. Alternatively, the cross-section of the chamber may be a polygon of higher degree than a quadrilateral.

The walls of the explosion chamber need not even be planar; they may be curved, for example forming wall sections of a tube, provided that the criteria mentioned in the preceding paragraph governing the circulation of the stock are adhered to.

Apparatus may be provided to render adjustable the spacing and/or angle between the slice plates 140, 141 so that the direction and size of the stock jet onto the wire may be varied according to individual requirements.

In certain applications, the upper slice plate 140 may be flexible so as to compensate for eccentricities in the forming mould and to ensure a mat of even thickness. Such flexibility may, for example, be applied to that portion of slice plate 140 downstream of bar 142*a* in FIG. 5(*b*).

The length of the shortened lower slice plate 141*a* relative to the upper slice plate 140 is also a matter giving scope for variation depending on individual stock requirements.

In some applications the suction box described may be replaced by a dewatering foil box or other dewatering means known in the art.

The flowbox of the invention may be used in conjunction with any type of single or multi-ply paper or board machine, either single or double wire forming, or vat forming.

What we claim is:

1. A flowbox for a paper, board or similar fibrous web making machine, the flowbox comprising an enclosed explosion chamber having upstream and downstream convergent wall portions converging from a top wall portion towards a bottom wall portion, wherein a stock inlet is disposed in the upstream wall portion and is directed towards the convergent downstream wall portion so that a jet of stock emanating from the inlet impinges against the convergent downstream wall portion adjacent the region of closest approach of the upstream and downstream wall portions before passing through a stock outlet, the stock outlet being provided by non-divergent upper and lower plates defining an exit slice, the lower plate being a continuation of the bottom wall portion, and the lower plate being shorter than the upper plate.

2. A flowbox as claimed in claim 1 wherein one of the convergent wall portions is substantially at right angles to the top wall portion and the angle of convergence between the convergent wall portions lies between 20° and 40°.

3. A flowbox as claimed in claim 2 wherein the angle of convergence is about 25°.

4. A flowbox as claimed in claim 1 wherein the upstream wall portion is substantially at right angles to the top wall portion.

5. A flowbox as claimed in claim 1 wherein the wall portions are provided by planar walls of the chamber.

6. A flowbox as claimed in claim 1 wherein the top and bottom walls are substantially parallel.

7. A flowbox as claimed in claim 1 wherein a turbulence generating bar is provided on the inner face of the upper plate between the chamber and the exit slice end of the lower plate.

8. A flowbox as claimed in claim 1 wherein the plates are convergent.

9. A flowbox as claimed in claim 1 wherein the stock inlet is arranged so that the jet of stock is directed at an angle to the downstream wall away from the stock outlet from the chamber such that the stock impinges against and is directed from the downstream wall toward said top wall and is caused to circulate violently.

10. Provided in a paper, board or similar fibrous web making machine, the combination of an explosion chamber flowbox as claimed in claim 1, with a dewatering means, the dewatering means being located underneath the projecting end of the upper plate.

11. The combination as claimed in claim 10 wherein the upper slice plate is flexible.

12. The combination as claimed in claim 10 wherein a turbulence generating bar is provided on the inner face of the upper plate between the chamber and the exit end of the lower plate.

13. The combination as claimed in claim 10 wherein the dewatering means is a suction box.

14. The combination as claimed in claim 10 wherein the dewatering means is a dewatering foil box.

* * * * *